United States Patent [19]

Van Bogaert et al.

[11] Patent Number: 4,964,443

[45] Date of Patent: Oct. 23, 1990

[54] WEFT MIXER

[75] Inventors: Philippe Van Bogaert, Schaarbeek; Denis Moeneclaey, Westrozebeke-Staden; Remi Lagache, Zillebeke, all of Belgium

[73] Assignee: Picanol N.V., Belgium

[21] Appl. No.: 366,628

[22] Filed: Jun. 16, 1989

[30] Foreign Application Priority Data

Jun. 17, 1988 [BE] Belgium ..... 08800691

[51] Int. Cl.[5] ..... D03D 47/38

[52] U.S. Cl. ..... 139/453

[58] Field of Search ..... 139/453

[56] References Cited

U.S. PATENT DOCUMENTS

| | | | |
|---|---|---|---|
| 3,092,150 | 6/1963 | Birmans et al. . | |
| 3,754,578 | 8/1973 | Remond . | |
| 4,191,222 | 3/1980 | Marshall | 139/453 |
| 4,537,228 | 8/1985 | Viscardi | 139/453 |
| 4,556,089 | 12/1985 | Juillard | 139/453 |
| 4,781,226 | 11/1988 | Moenclaey et al. | 139/453 |

FOREIGN PATENT DOCUMENTS

| | | | |
|---|---|---|---|
| 0102063 | 8/1983 | European Pat. Off. . | |
| 630124 | 12/1978 | Switzerland | 139/453 |

*Primary Examiner*—Andrew M. Falik

*Attorney, Agent, or Firm*—Bacon & Thomas

[57] ABSTRACT

A mechanism for presenting weft threads on rapier weaving machines includes a cam mechanism, cam follower devices, armatures connected to the cam follower devices, and thread presentation arms. The cam mechanism and cam follower devices impart reciprocating movements to the armatures such that, alternately, for each successive weaving cycle, the armature connected to one of the cam follower devices cause the movement of one of the thread presentation arms into a presented position, while the armatures connected to the other cam follower device move back to a rest position a thread presentation arm which has just been presented.

16 Claims, 7 Drawing Sheets

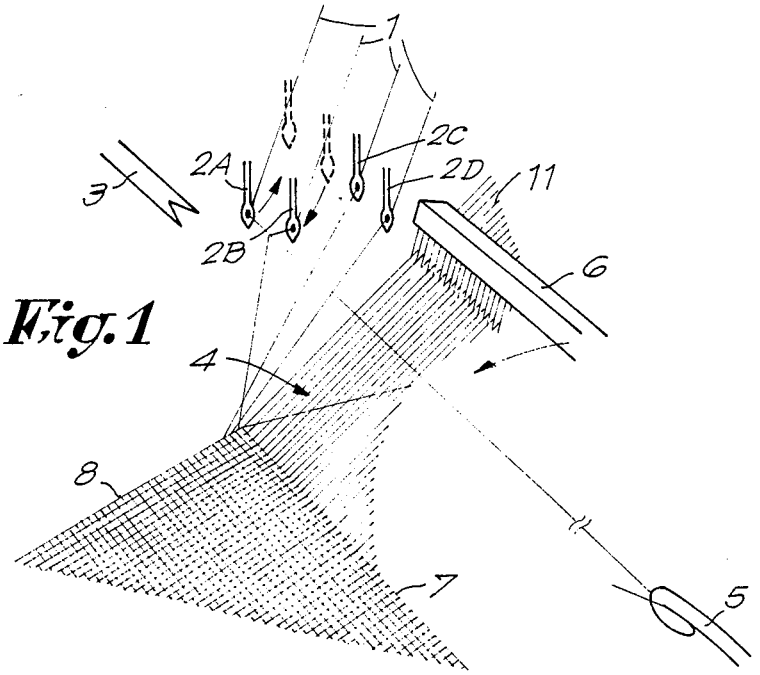
Fig. 1
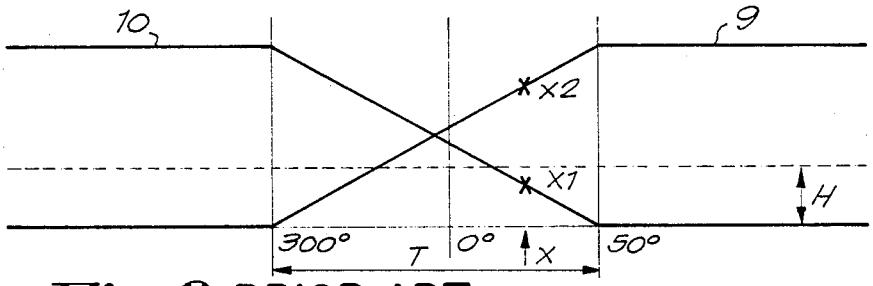
Fig. 2 PRIOR ART
Fig. 3
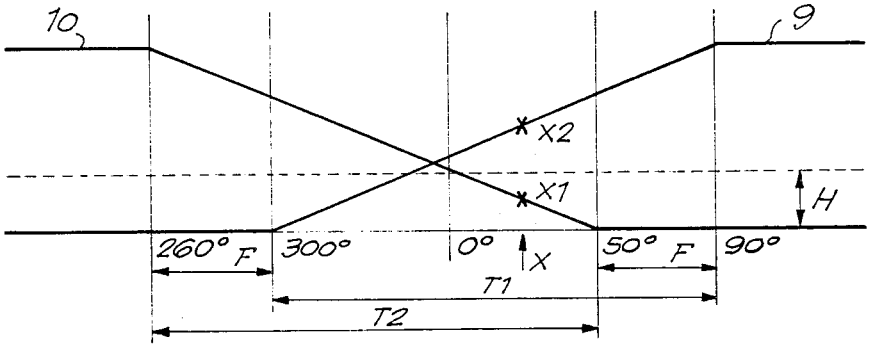

Fig. 5
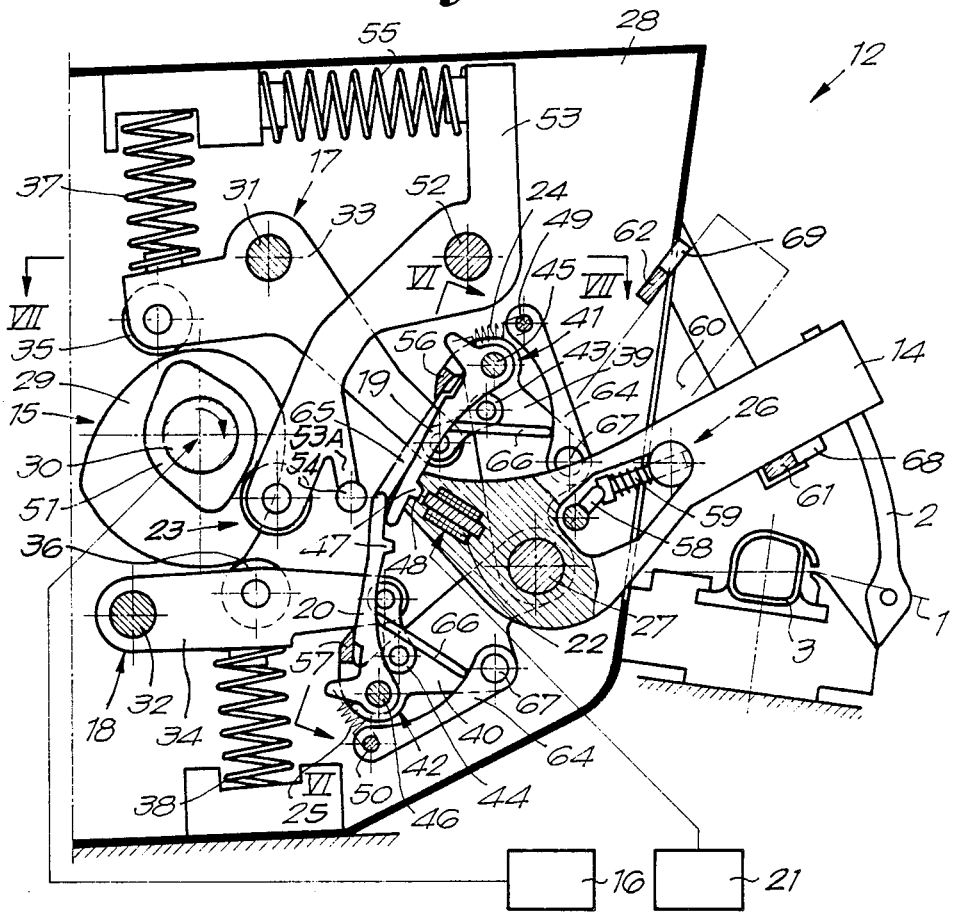
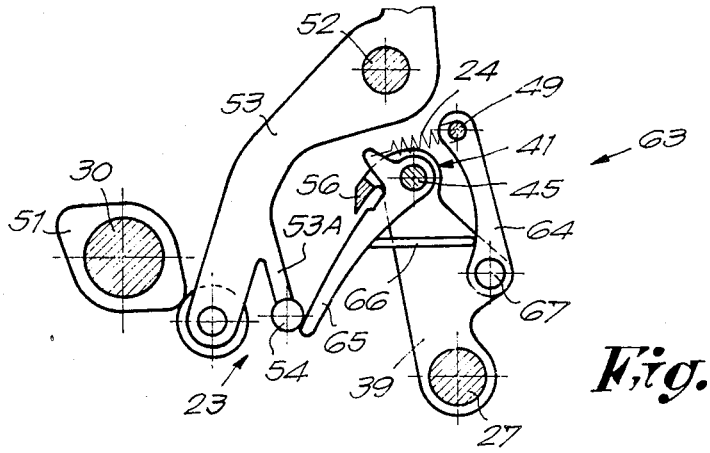
Fig. 10

WEFT MIXER

BACKGROUND OF THE INVENTION

This invention concerns a mechanism for presenting weft threads on weaving machines. The mechanism is intended primarily to present weft threads to the grippers of rapier weaving machines.

As is known, several aspects are involved in presenting a weft thread to a gripper. First it is important, in order to obtain smooth operation, when a thread has to be presented twice or several times in succession, that the thread presentation arm should not carry out a to and fro motion, but should remain in its presented position. A weaving machine which applies this principle is known from U.S. Pat. No. 3,092,150.

On rapier weaving machines it is also important that the motion of the thread presentation arm from the presented position to the rest position should be carried out as late as possible, in order for the weft thread not to come in contact with the upper warp sheet. Also, presentation of a weft thread must begin soon enough in order to bring the weft thread into the path of the gripper in good time. Otherwise, if the weft thread is presented too soon, it may come in contact with the weft thread inserted previously, so that the weft threads may be damaged or become entangled.

Normally the optimum conditions are achieved when a presentation arm being activated and a presentation arm being deactivated cross each other at about the moment that the last weft thread to have been inserted is being beaten up. At that moment, the weft threads attached to the respective presentation arms have a more or less common starting point, namely the end of the fell line on the picking side. The threads cannot get crossed then, so there is no chance of entanglement.

On known mechanisms, the presentation arm of the thread to be presented on the one hand and the presentation arm of a thread which has just been presented and inserted into the shed on the other are moved simultaneously over the same period. Since the time over which this period extends is very restricted because of the above-mentioned requirements, the thread presentation arms have to make a very quick, brusque movement, which has disadvantages in terms of the forces involved, wear, noise etc.

SUMMARY OF THE INVENTION

The present invention has as its aim a mechanism for presenting weft threads which does not have the above-mentioned disadvantages, yet which meets all the above-mentioned requirements. For this purpose, according to the invention, use is made of a mechanism by means of which a phase displacement is obtained between the period during which a thread presentation arm is moved downwards, and the period during which the thread presentation arm which has presented a weft thread in the previous cycle is raised once more. This offers the advantage that the thread presentation arm which has to present the next weft thread in the path of the gripper can be moved downwards before the thread presentation arm of the last weft thread to have been inserted is raised again.

To this end, the mechanism according to the invention includes a number of thread presentation arms which can swivel to and fro between two positions; a cam mechanism; a drive which drives said cam mechanism at half machine speed; two cam follower devices which move independently of each other and which operate in conjunction with said cam mechanism; two armatures per thread presentation arm, where said armatures are attached respectively to the cam follower devices and can operate in conjunction with the thread presentation arms; means to enable the armatures to engage the corresponding thread presentation arms at particular moments and over a particular period; means to force the armatures into a unlocked position; and means to hold the thread presentation arms in the last position into which they have been forced by the armatures, the cam mechanism and said cam follower devices imparting a reciprocating motion to the armatures, such that alternately, for each successive weaving cycle, the armatures connected to one cam follower device cause the presentation of one of the thread presentation arms, while the armatures connected to the other cam follower device can move back a thread presentation arm which has just been presented.

BRIEF DESCRIPTION OF THE DRAWINGS

In order to better explain the characteristics according to the invention, a preferred embodiment is now described, by way of example only and without being limitative in any way, with reference to the accompanying drawings, where:

FIG. 1 shows schematically the presentation of weft threads to the gripper of a rapier weaving machine;

FIG. 2 shows the course of the movements of two thread presentation elements for known mechanisms;

FIG. 3 shows the course of the movements of two thread presentation elements for the mechanism according to the present invention;

FIG. 5 shows a cross-section of the mechanism according to the invention;

FIGS. 9 and 10 show a part of the mechanism in two different positions, corresponding essentially to the cross-section along the line IX—IX in FIG. 6;

DESCRIPTION OF THE PREFERRED EMBODIMENT

Figure 4:
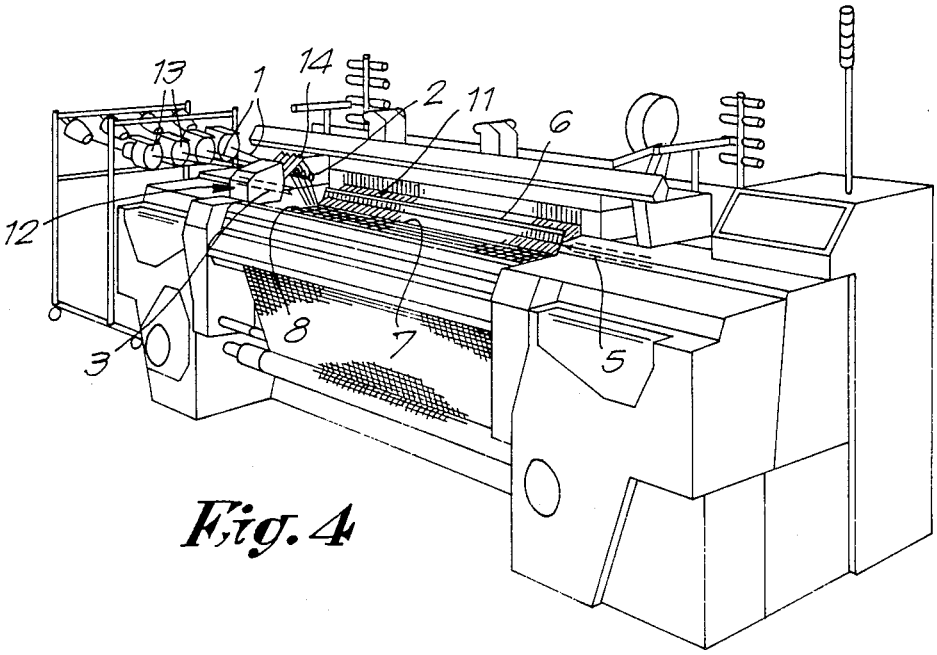
FIG. 4 shows a weaving machine which uses the mechanism according to the invention.

As shown in FIG. 1, on rapier weaving machines it is generally known to bring the different weft threads 1 one after another into the path of the feed gripper 3, according to the required weaving pattern, by means of thread presentation elements 2A to 2D which move up and down. As is known, the feed gripper 3 then inserts the presented thread 1 into the shed 4, where said thread is then taken over by the receiving gripper 5. The weft thread which has been inserted is then beaten up against the cloth fell 7 by the reed 6. In order to provide another weft thread for the next weaving cycle, the thread presentation element 2A is raised once more, while the thread presentation element, for example 2B, of the next weft thread to be inserted is moved downwards.

If the thread presentation elements 2A to 2D consist of thread eyes, as shown in FIG. 1, the weft threads 1 in the rest position remain attached to the edge 8 of the cloth.

It is clear that, in order to obtain smooth operation, the movements of the thread presentation elements 2A to 2D must meet the requirements mentioned in the Background of the Invention.

On the known mechanisms, it is usual for the downwards movement of the thread presentation element 2B of the next weft thread 1 to be inserted to be carried out exactly simultaneously with and over the same period T as the upwards movement of the thread presentation element 2A which has just presented the last weft thread to have been inserted. The course of the movements of the thread presentation elements 2A and 2B is thus respectively as shown by curves 9 and 10 in FIG. 2, in which the movement of the thread presentation elements is drawn as a function of the angle of rotation of the main drive shaft of the weaving machine, where zero degrees corresponds to the moment at which a weft thread is beaten up.

In FIG. 2, H represents the range over which a weft thread 1 which has been presented can be gripped by the feed gripper 3. Beating up occurs at zero degrees, while a thread which has been presented is gripped by the gripper 3 at moment X.

Here it is important for the return movement of presentation element 2A to be carried out as late as possible, so that the corresponding weft thread 1 does not come in contact with the upper warp sheet 11. On the other hand, presentation of the following weft thread 1 by means of the thread presentation element 2B must be carried out as early as possible, in order for the corresponding weft thread to be gripped at the moment the gripper 3 passes. In other words, this means that the point Xl must be in the range H. Here it is important that the next thread to be inserted into the shed should not be presented too soon, otherwise, as shown in FIG. 1, it may come into contact with the weft thread which has been inserted but not yet beaten up, which could result in both threads becoming entangled. In order to avoid this it is usual to ensure that the curves 9 and 10 cross each other at a moment which coincides more or less with the moment at which the reed 6 comes up against the cloth fell 7.

Due to the fact that the above-mentioned requirements must be met, and due also to the fact that the above-mentioned movements of the thread presentation elements 2A and 2B are carried out in precisely the same period T, on known mechanisms the disadvantage arises that the thread presentation elements 2A to 2B must carry out rapid, brusque movements, as shown by the relatively steep leading and trailing edges of curves 9 and 10 in FIG. 2, at least during period T.

The present invention concerns a mechanism for presenting weft threads 1, in which it is possible for the presentation elements to be moved less brusquely, without deviating from the above-mentioned requirements. For this purpose, as shown in FIG. 3 the duration of the periods T1 and T2 during which the corresponding thread presentation elements 2A and 2B are moved is extended, thus also producing a phase displacement of the two periods.

FIG. 4 shows a weaving machine which uses the mechanism 12 according to the invention. The weft threads 1 are led to the thread presentation elements 2 from different thread supplies 13, in the known way.

Figure 6:
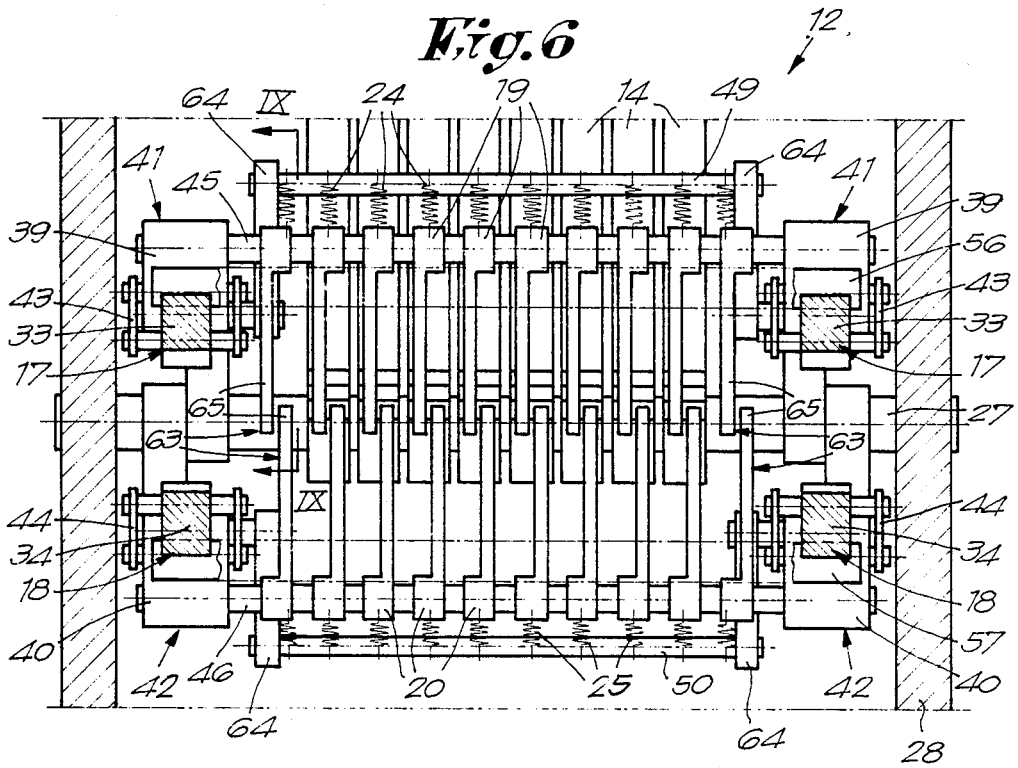
FIG. 6 shows a cross-section along the line VI—VI in FIG. 5.
Figure 7:
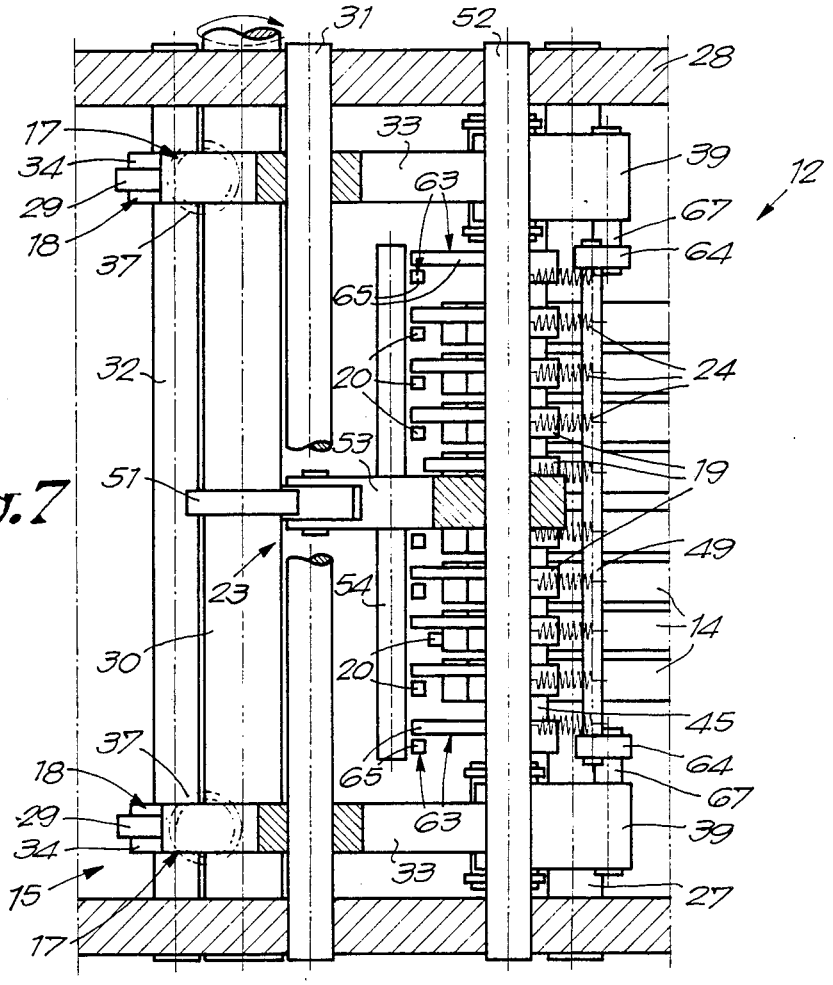
FIG. 7 shows a cross-section along the line VII—VII in FIG. 5.

As shown in FIGS. 5 to 7, the mechanism 12 according to the invention includes a number of thread presentation arms 14 which swivel to and fro between two positions; a cam mechanism 15; a drive 16 which drives said cam mechanism 15 at half machine speed; two cam follower devices 17 and 18 which move independently of each other and which operate in conjunction with cam mechanism 15; for each thread presentation arm 14, two armatures 19 and 20, attached to the cam follower devices 17 and 18 respectively, which can operate on the thread presentation arms 14; means 21, 22 to enable a number of the armatures 19 and 20 to operate on the respective thread presentation arms 14 at each weaving cycle, at particular moments and during a particular period, including solenoids 22 controlled by a switching device 21 in order to bring the armatures 19 and 20 into the engaged position or otherwise, and possibly also a pusher mechanism 23 in order to make the armatures 19 and 20 engage the thread presentation arms 14 in a respective manner; a means—preferably elastic devices, such as springs 24 and 25—to force the armatures 19 and 20 into a disengaged position; and a means 26 for holding the thread presentation arms 14 in the last position into which they have been forced by the armatures 19 and 20. The armatures 19 and 20 can thus either be pulled directly by the respective solenoids 22, or first be pushed against all the solenoids 22 by means of said pusher mechanism 23, whereupon the armatures 19 or 20 whose corresponding solenoids 22 are energized remain pulled into their engaged position. The use of such a pusher mechanism 23 facilitates the drawing in of the armatures 19 and/or 20.

The thread presentation arms 14 consist of levers which at their outer ends bear the thread presentation elements 2, and which swivel about a common shaft 27 which, as shown in FIG. 6, is mounted at both ends in the housing 28.

In the preferred embodiment, as shown in FIGS. 5 and 7 the above-mentioned cam mechanism 15 consists of two identical cams 29 mounted in the housing 28 on opposite sides of a continuous drive shaft 30, which is connected to the above-mentioned drive 16.

The above-mentioned cam follower devices 17 and 18 consist essentially of levers 33 and 34 which can pivot on shafts 31 and 32, and which are provided with cam followers, such as rollers 35 and 36, where said levers are kept in contact with said cams 29 by means of pressure springs 37 and 38. The cam follower devices 17 and 18 consist further of arms 39 and 40 which can pivot about said shaft 27, attached at their ends 41 and 42, on opposite sides of the shaft, to the free ends of the levers 33 and 34, by means of hinged rods 43 and 44, in the form of links. It is clear that, as shown in FIGS. 6 and 7, the shafts 31 and 32 should preferably extend through the housing 28. It is also clear that there should be a construction such as described above on either side of the mechanism, that is on each of cams 29, each construction including of the levers 33–34, the springs 37–38, the arms 39–40 and the rods 43–44.

Here it should be noted that, as shown in FIG. 5, the lever 17 is pivoted in the middle, while the roller 35 is mounted on the end situated opposite the end to which the rod 43 is attached. The construction of lever 34 is different. This lever is pivoted at its end, while the above-mentioned roller 36 in this case is situated in the middle of the lever 34.

Preferably, the axes of rotation of the shafts 30, 31 and 32 all lie in the same plane, where this plane is perpendicular to the plane in which the axes of rotation of the shafts 27 and 30 lie. The distance between the shafts 30 and 31 and the distance between the shafts 30 and 32 may possibly be equal to each other.

The above-mentioned armatures 19 and 20, of which there is one pair per thread presentation arm 14, are essentially formed by two fingers pointing towards each other and which pivot on two common mounting shafts, 45 and 46 respectively. As shown in FIGS. 5 and 6, the mounting shaft 45 of the upper armatures 19 is fitted between the ends 41 of the arms 39 which are located on opposite sides of the shaft 27. In a similar way, the mounting shaft 46 is fitted between the ends 42 of the arms 40 located on opposite sides of the mechanism.

As can be seen from FIG. 5, the armatures 19 and 20 each have at their free end a tooth 47, such that as a result of the rotation of the armatures 19 and 20, said teeth 47 can engage in the recesses 48 situated at the opposite ends of the thread presentation elements 2 of thread presentation arms 14.

The above-mentioned springs 24 and 25 are attached to the corresponding armatures 19 and 20 in a suitable way, and further are attached to two common mounting elements, 49 and 50 respectively. The springs 24 and 25, which in the embodiment shown consist of tension springs, operate on the armatures 19 and 20 in such a way that the latter are forced into their disengaged position.

The above-mentioned pusher mechanism 23 for pressing the armatures 19 and 20 against the thread presentation arms 14 consists of a cam 51, mounted on the drive shaft 30, and, operating in conjunction with it, a cam follower device in the form of a lever 53 which pivots about a shaft 52 and which is provided with a pusher device 54 which can make contact with all armatures 19 and 20. The pusher device 54 is preferably mounted elastically, and for this purpose is for example mounted on the free end of a springy component 53A. A pressure spring 55 ensures that the lever 53 remains in contact with the cam 51. As shown in FIG. 7 the cam 51 is located between the two cams 29. Further, there is only one lever 53. The pusher device 54 consists of a rod which extends along the different armatures 19 and 20.

The above-mentioned solenoids 22 are built into the thread presentation arms 14, preferably close to the recesses 48, such that once an armature 19 or 20 is brought into the engaged position, this armature can be held in its engaged position against the recall force of the spring 24 or 25 by energizing the corresponding solenoid 22.

In order to limit the rotation of the armatures 19 and 20 in their disengaged position, they may be fitted with stops, 56 and 57 respectively, along their length. For this purpose the stop 56 for the armatures 19 can include a strip mounted between the ends 41 of the arms 39 located on opposite sides of the mechanism. In a similar way, the stop 57 can include a strip extending between the ends 42 of the arms 40.

Figure 8:
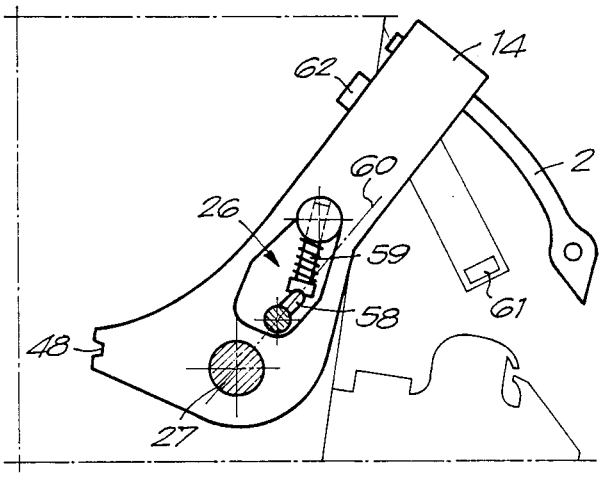
FIG. 8 shows the same thread presentation arm shown as in FIG. 5, but in a different position.

The above-mentioned means 26 to hold the thread presentation arms 14 in the position into which they have last been forced by the armatures can be of various types. As shown in FIG. 5, and for another position in FIG. 8, means 26 can for example consist of a support 58 which is fixed-mounted in the housing 28, and for each thread presentation arm 14 a tension element 59 which extends between said support 58 and the thread presentation arm 14 at an oblique angle to the plane 60 defined by the support 58 and the shaft 27, such that as a result of the movement of the thread presentation arm 14 the corresponding tension element 59 is moved from one side of the plane 60 to the other, such that it passes through a dead point at which the tension force in the tension element 59 is greatest. The second position is shown in FIG. 8. Further, stops 61 and 62 which determine the highest and lowest position of the thread presentation arms 14 are placed along the thread presentation arms 14. Clearly, the means 26 can also consist of other mechanisms which can be moved through a dead point.

In a variant, the stops 61 and 62 can consist of permanent magnets, such that they fulfil the function of the above-mentioned means 26.

Figure 9:
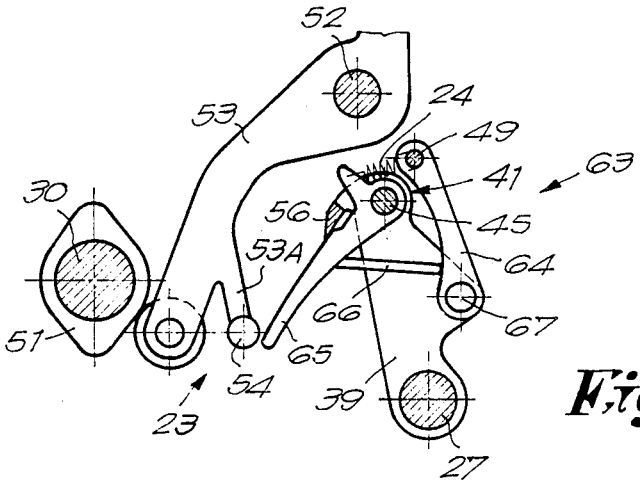

Finally, as shown in the figures the mechanism 12 can possibly be equipped with a means 63 by which the tension in the springs 24 and 25 can be increased shortly before the armatures 19 and 20 are thrown, until shortly after the pusher element 54 is withdrawn, in order to prevent the armatures 19 and/or 20 from failing to come out of the recesses 48 when their solenoids 22 are de-energized, due to residual magnetism and friction. Clearly, such means 63, which could be termed a "mechanical amplifier", are provided both for the upper armatures 19 and for the lower armatures 20. In order to make its construction and operation clearer, the means 63 which operate in conjunction with the upper armatures 19 are shown separately in FIGS. 9 and 10, respectively for two different positions of said means.

The means 63 for this purpose includes rockers 64 attached to the inside of the arms 39 and bearing on their free ends the above-mentioned mounting elements 49, to which the different springs 24 are attached, and fingers 65 mounted on the mounting shaft 45 in a similar way to the armatures, on either side of the series of armatures 19 and next to them. On the fingers 65 are pushers 66 which can push against the rockers 64 at a short distance from the pivot 67 of said rockers 64. The fingers 65 can be moved by means of the pusher device 54 in a similar way to the armatures 19. Finally, there can be a spring 24 between each finger 65 and the mounting element 49, in a similar way as for the armatures 19.

From FIG. 10 it is clear that whenever the fingers 65 are pushed in with respect to the arms 39 by means of the pusher device 54, the rockers 64 are turned aside, such that the mounting element 49 is displaced and all the springs 24 are extended further, thus increasing the tension force.

The construction of the means 63 which operate in conjunction with the armatures 20 is similar.

Figure 11:
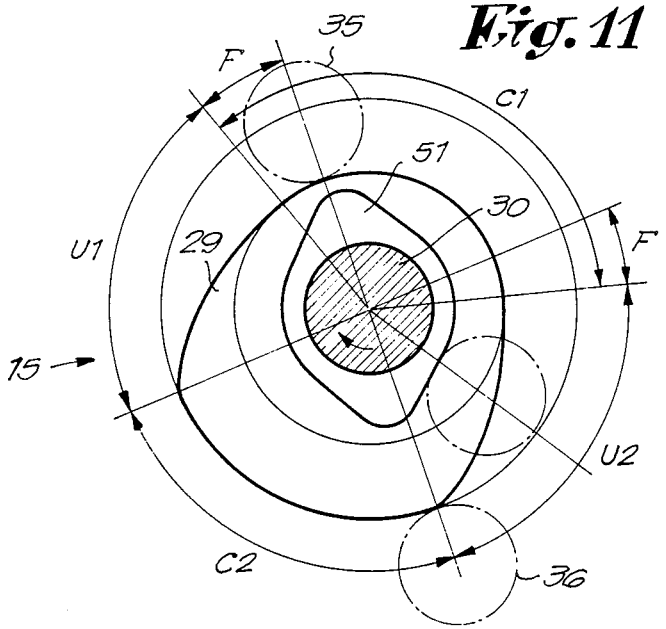
FIG. 11 shows the cams shown in FIG. 5, to a larger scale.

The cams 29 and 51, which are fixedly-mounted on the same shaft 30, preferably have the form shown in FIG. 11, where the cams 29 include two arcs of circles C1 and C2, the first of which has a smaller radius and the second a greater, and two transition sections U1 and U2 which join the two circular arcs Here it is important for the transition sections U1 and U2 to be situated asymmetrically with respect to the centre, where this asymmetry is characterized by the phase displacement F. Clearly, whenever the rollers 35 and 36 make contact with the circular arcs Cl and C2, the armatures 19 and 20 will not be moved. Conversely, whenever the transition sections U1 and U2 move along the rollers, clearly the armatures 19 and 20 will be moved.

The periods T1 and T2 shown in FIG. 3 should preferably amount to 150 degrees of rotation of the main shaft, while the phase displacement F should preferably amount to 40 degrees of rotation of the main shaft. Since the cams 29 turn at half machine speed, this means that the angle F in FIG. 11 must be 20 degrees, while the transition sections U1 and U2 each make an angle of 75 degrees.

The cam 51 is of course placed such that the armatures 19 and 20 are only pressed forwards whenever they are not moved towards or away from each other, i.e. whenever the rollers 35 and 36 are located on the circular arcs C1 and C2.

The operation of the mechanism for different positions is shown schematically in FIGS. 12 to 15. For the sake of clarity only two thread presentation arms are shown, indicated by 14A and 14B in order to distinguish them.

Figure 12:
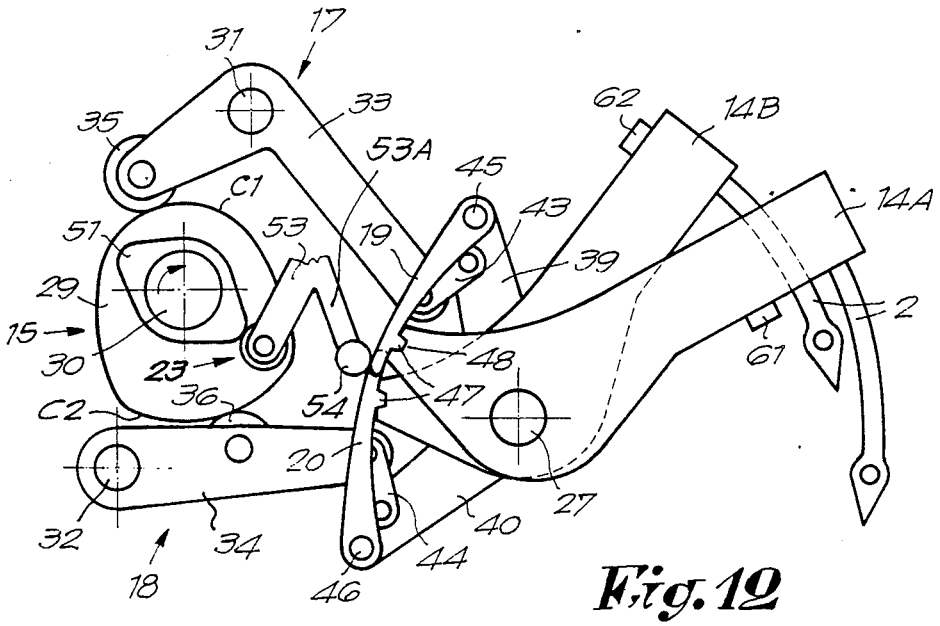
FIGS. 12 to 15 show schematically the mechanism in different positions, for the sake of illustration of the operation.

In FIG. 12, the mechanism starts from a position in which the thread presentation arm 14A is in its presented position, while the thread presentation arm 14B is raised, or in other words in its rest position. The roller 35 makes contact with the circular arm C1 with the smaller radius, and the roller 36 makes contact with the circular arc C2 with the greater radius. The armatures 19 and 20 are then in the positions in which they are farthest from each other. As a result of the armatures 19 and 20 being pressed towards the thread presentation arms 14 by means of the cam 51 and the pusher mechanism 23, the teeth 47 engage the end of thread presentation arm 14A and the end of thread presentation arm.

If at the next cycle it is wished to bring the thread presentation arm 14A into its rest position and to present the thread presentation arm 14B, then the solenoids 22 of the thread presentation arms 14A and 14B to be moved are energized by means of the switching device 21.

Figure 13:
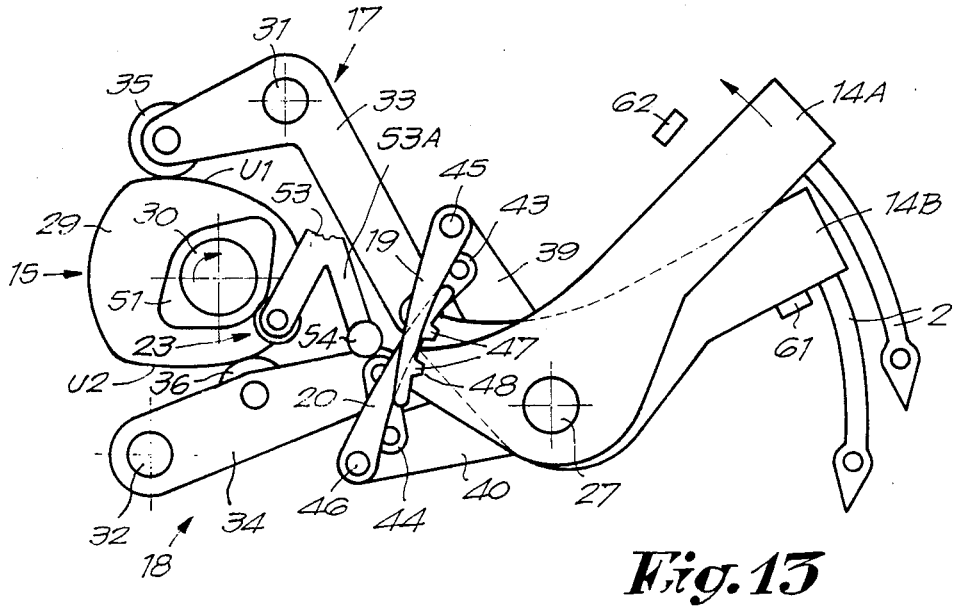

When the shaft 30 turns farther, then as shown in FIG. 13 the pusher device 54 comes away from the armatures 19 and 20. The armatures 19 and 20 of the thread presentation arms 14A and 14B are however kept in their engaged position by the energized solenoids 22. Since the rollers 35 and 36 now make contact with the transition sections U1 and U2, the armatures 19 and 20 are moved towards each other and so carry out a sort of crossing motion. As a result of the above-mentioned phase displacement F the roller 36 comes into contact with the transition section U2 earlier than the roller 35 comes in contact with the transition section U1. As a result the arm 14B to be presented begins its movement earlier than the thread presentation arm 14A to be raised.

Figure 14:
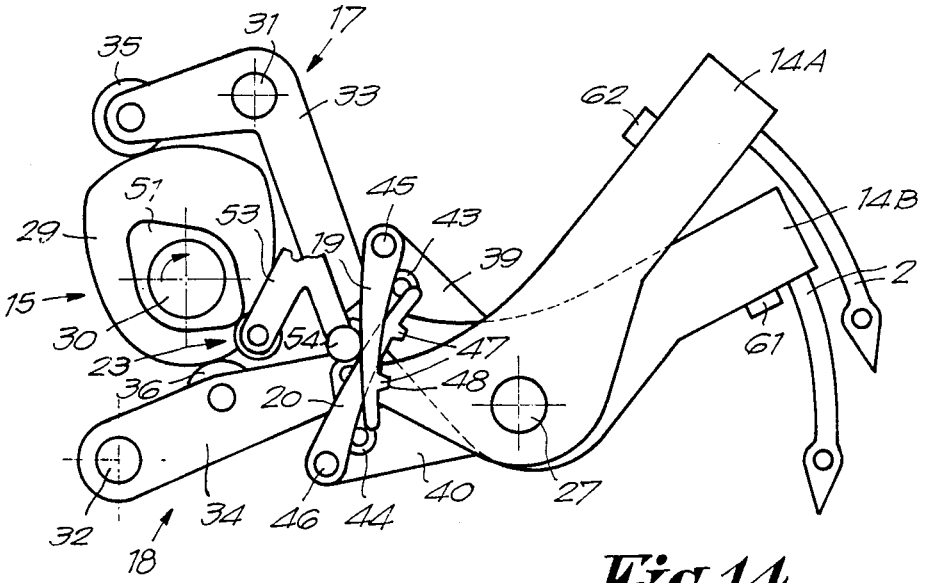

After the arms 14A and 14B have been moved, the solenoids 22 can be de-energized. The rollers 35 and 36 then travel over the circular arcs C2 and C1 respectively, as shown in FIG. 14.

Here also the armatures 19 and 20 are pushed forwards. If the positions of the arms 14A and 14B now have to be reversed, their respective solenoids 22 are energized, such that when the pusher device 54 moves, the armatures 19 and 20 come into their engaged position once more. Clearly, if other arms than 14A and 14B have to be moved, then the corresponding solenoids are energized.

Figure 15:
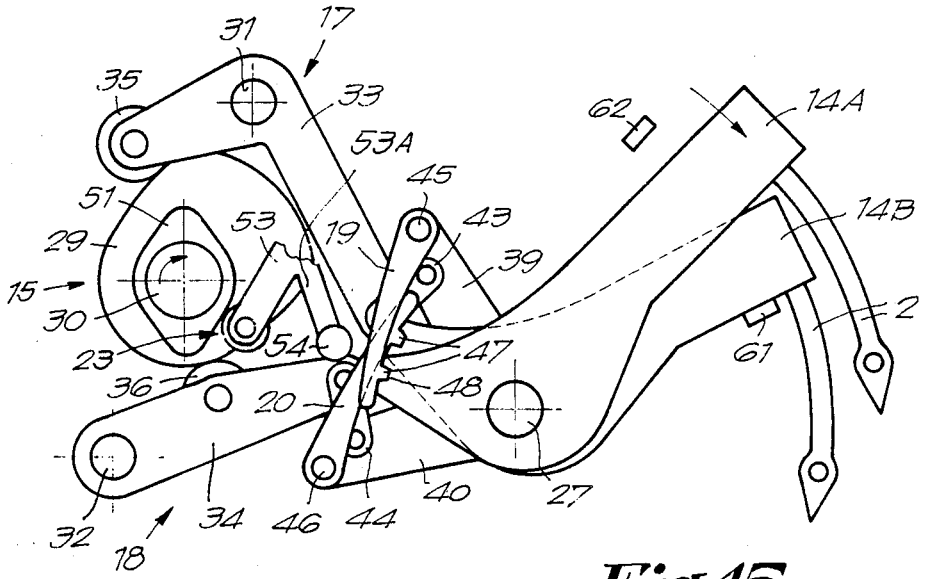

FIG. 15 shows how in a following step the armatures 19 and 20 as they are moving apart provide the movement of the thread presentation arms 14A and 14B. In this case also, the movement of the thread presentation arm 14A to be presented begins earlier than the movement of the thread presentation arm 14B to be brought into the rest position.

Here it should be noted that in one position, as shown in FIG. 13, the armatures 19 and 20 press against the ends of the thread presentation arms 14A and 14B, while in the other position, as shown in FIG. 15, thread presentation arms 14A and 14B are moved as a result of the armatures 19 and 20 pulling on their ends.

As shown in FIG. 5, proximity switches 68 and 69 may be fitted near to the stops 61 and 62, in order to check whether the thread presentation arms 14 have reached their required position. If this is not the case, the machine is stopped.

The present invention is not limited to the embodiments described by way of example and shown in the figures; on the contrary, such a mechanism for presenting weft threads on weaving machines can be made in all forms and dimensions while still remaining within the scope of the invention.

We claim:

1. A mechanism for presenting weft threads on weaving machines during a plurality of weaving cycles, said weaving machine operating at a particular machine speed, comprising:

a plurality of thread presentation arms which swivel to and fro between two positions;

a cam mechanism;

drive means for driving said cam mechanism at half said machine speed;

two cam follower devices supported by means for permitting the cam follower devices to move independently of each other in response to movement of said cam mechanism;

armature means including two armatures for each thread presentation arm, each armature connected to a respective cam follower device, for moving the thread presentation arms between said two positions in response to movement of the cam follower devices upon engagement with the thread presentation arms;

engagement means to enable a plurality of said armatures to engage their respective thread presentation arms during each weaving cycle, at particular moments and during a particular period;

disengagement means to force said armatures to disengage said thread presentation arms; and holding means to hold the thread presentation arms in a position into which they have been moved by the armatures, wherein said cam mechanism and the cam follower devices impart reciprocating movements to the armatures such that, alternately, for each successive weaving cycle, the armatures connected to one of the cam follower devices cause the movement of one of the thread presentation arms into a presented position, while the armatures connected to the other cam follower device move back to a rest position a thread presentation arm which has just been presented.

2. A mechanism as claimed in claim 1, wherein the cam mechanism comprises at least one asymmetric cam which causes said armatures connected to one of said cam follower devices to move a thread presentation arm into its presented position earlier than said armatures connected to the other cam follower device cause a thread presentation arm to move back to its rest position.

3. A mechanism as claimed in claim 2, wherein the asymmetric cam consists of two circular arc surfaces with different radii and two transition sections between the arc surfaces, said transition sections being situated asymmetrically with respect to the center of the cam, and wherein cam followers on said cam follower devices which rest against the asymmetric cam are located substantially opposite from each other in respect to the center of the cam.

4. A mechanism as claimed in claim 1, wherein the cam follower devices each include a lever equipped with a cam follower which moves in response to movement of said cam mechanism, and a swivel arm which can swivel about a fixed pivot and which is connected at one end to the corresponding lever, and wherein each said swivel arm has at its other end a mounting shaft on which the corresponding armatures are swivel-mounted.

5. A mechanism as claimed in claim 4, wherein said cam mechanism includes a cam and wherein one of the levers pivots about its middle around a first shaft, bearing at one end said cam follower and connected at the other end to the swivel arm, while another lever is swivel-mounted at one of its ends on a second shaft, at the other end is connected to the swivel arm, and in the middle bears said cam, said cam follower moving in response to movement of said cam.

6. A mechanism as claimed in claim 1, wherein each of the thread presentation arms is a lever which pivots about a shaft, bearing at one end a thread presentation element and at the other end a recess in which said armatures engage.

7. A mechanism as claimed in claim 6, wherein said armatures are swivelling fingers bearing at their free ends teeth which engage in the recesses in the thread presentation arms, and wherein the respective armatures connected to the two cam follower devices are mounted opposite each other in respect to said cam follower devices and perform an in-and-out, crossing motion with their teeth.

8. A mechanism as claimed in claim 1 wherein the engagement means to enable a plurality of said armatures to engage the thread presentation arms at particular moments and during a particular periods includes solenoids and means including a switching device for separately energizing the solenoids, said armatures being held in an engaged position with the respective thread presentation arms by energization of corresponding solenoids.

9. A mechanism as claimed in claim 1, wherein the means to enable the armatures to engage the thread presentation arms at particular moments and during a particular period include pusher mechanisms which make the armatures engage the thread presentation arms, together with a solenoid for each thread presentation arm and controlled by a switching device, and wherein said solenoid, when it is energized, holds a respective armature in the engaged position with a respective thread presentation arm after a corresponding pusher mechanism has ceased to make the respective armature engage the respective presentation arm.

10. A mechanism as claimed in claim 9, wherein each pusher mechanism includes a cam which turns at half machine speed in coordination with said cam mechanism, together with a cam follower which moves in response to movement of the cam, wherein said cam follower has a pusher device which can bring the armatures into their engaged position with the thread presentation arms, and wherein said cam pushes the armatures once per weaving cycle.

11. A mechanism as claimed in claim 10, wherein the pusher device is mouthed elastically on the cam follower.

12. A mechanism as claimed in claim 1, wherein the disengagement means to force the armatures into a disengaged position comprises springs.

13. A mechanism as claimed in claim 1, wherein the disengagement means are elastic devices and wherein the engagement means are provided with a means which, from shortly before the armatures are enabled to engage said thread presentation arms until shortly after they are released, increase tension in the elastic devices which forces the armatures into their disengaged position.

14. A mechanism as claimed in claim 13, characterized in that the means to increase the tension in said elastic devices comprises rockers to which the elastic devices are attached at one end by mounting elements, and fingers which are moved together with the armatures and which bear a pusher which makes contact with the rockers so that the pusher moves the rockers when the armatures and the fingers are moved into engagement with said presentation arms, so that said elastic devices are extended.

15. A mechanism as claimed in claim 1 wherein the holding means includes a mechanism which can be pulled through a dead point, together with stops which limit the movement of the thread presentation arms.

16. A mechanism as claimed in claim 1 wherein the holding means comprises stops in the form of permanent magnets.

* * * * *